US008513555B2

(12) United States Patent
Liu

(10) Patent No.: US 8,513,555 B2
(45) Date of Patent: Aug. 20, 2013

(54) POWER BUTTON AND ELECTRONIC DEVICE USING SAME

(75) Inventor: Zhi-Hua Liu, Shenzhen (CN)

(73) Assignees: Fu Tai Hua Industry (Shenzhen) Co., Ltd., Shenzhen (CN); Hon Hai Precision Industry Co., Ltd., New Taipei (TW)

( * ) Notice: Subject to any disclaimer, the term of this patent is extended or adjusted under 35 U.S.C. 154(b) by 222 days.

(21) Appl. No.: 13/104,212

(22) Filed: May 10, 2011

(65) Prior Publication Data

US 2012/0152710 A1 Jun. 21, 2012

(30) Foreign Application Priority Data

Dec. 21, 2010 (CN) ..... 2010 1 0598908

(51) Int. Cl.
*H01H 3/12* (2006.01)
*H01H 13/14* (2006.01)

(52) U.S. Cl.
USPC ..... 200/341

(58) Field of Classification Search
USPC ..... 200/341, 329, 50.02, 50.12, 50.14, 200/200/520, 302.1, 302.2, 314, 530, 538–539, 200/318.1
See application file for complete search history.

(56) References Cited

U.S. PATENT DOCUMENTS

| | | | | |
|---|---|---|---|---|
| 4,453,052 | A * | 6/1984 | Semian et al. | 200/85 R |
| 4,885,443 | A * | 12/1989 | Simcoe et al. | 200/296 |
| 5,036,441 | A * | 7/1991 | Herron | 362/95 |
| 6,987,233 | B2 * | 1/2006 | Cole et al. | 200/341 |
| 7,189,932 | B2 * | 3/2007 | Kim | 200/5 R |
| 8,093,522 | B2 * | 1/2012 | Cheng | 200/341 |

* cited by examiner

*Primary Examiner* — Edwin A. Leon
*Assistant Examiner* — Anthony R. Jimenez
(74) *Attorney, Agent, or Firm* — Altis Law Group, Inc.

(57) ABSTRACT

A power button includes a holder and a push-button. The holder includes an assembling hole defined therein, an annular groove defined on a top portion of an inner wall of the assembling hole, and a latching slot defined in the inner wall of the assembling hole located adjacent to and apart from the annular groove. The push-button includes a cover body in the shape of conical frustum, a plurality of hook portions formed on the cover body. A shape of the annular groove allows it to mesh with the cover body, the cover body is movably received in the annular groove, and the hook portions engage with the latching slot.

20 Claims, 5 Drawing Sheets

POWER BUTTON AND ELECTRONIC DEVICE USING SAME

BACKGROUND

1. Technical Field

The present disclosure relates, generally, to buttons, and particularly to a power button to be used in an electronic device.

2. Description of Related Art

A power button is a simple switch mechanism for controlling electronic device. Power buttons are typically made of hard or rigid materials, such as plastics or metals.

However, a typical power button cannot be sealed properly from the intrusion of contaminants such as dust or water. This may result in a short circuit or corrosion of electronic elements in the electronic device.

Therefore, there is room for improvement in the art.

BRIEF DESCRIPTION OF THE DRAWINGS

Many aspects of the disclosure can be better understood with reference to the following drawings. The components in the drawings are not necessarily drawn to scale, the emphasis instead being placed upon clearly illustrating the principles of power button and electronic device using the same. Moreover, in the drawings like reference numerals designate corresponding parts throughout the several views. Wherever possible, the same reference numerals are used throughout the drawings to refer to the same or like elements of an embodiment.

DETAILED DESCRIPTION

Figure 1:
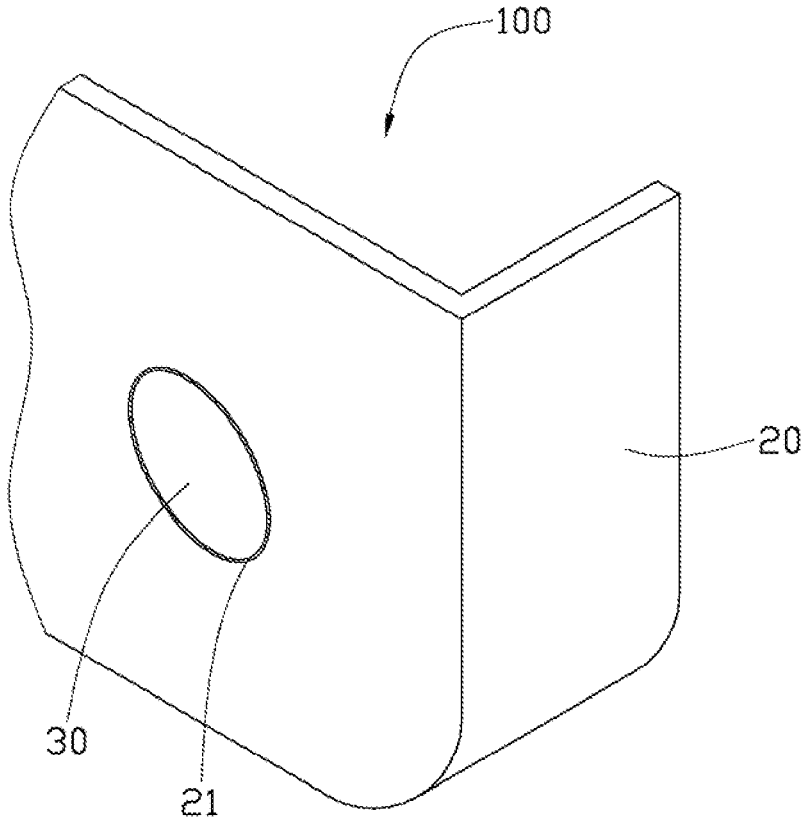
FIG. 1 is a partial, isometric view of an embodiment of an electronic device, and the electronic device includes a power button.

Referring to FIG. 1, an embodiment of an electronic device 100 includes a housing 20 and a power button 30. The housing 20 defines a receiving hole 21 to receive the power button 30. The electronic device 100 may be a notebook computer, a desktop computer, a liquid crystal display or other electronic devices capable of employing the power button 30. In the illustrated embodiment, the electronic device 100 is a notebook computer.

Figure 2:
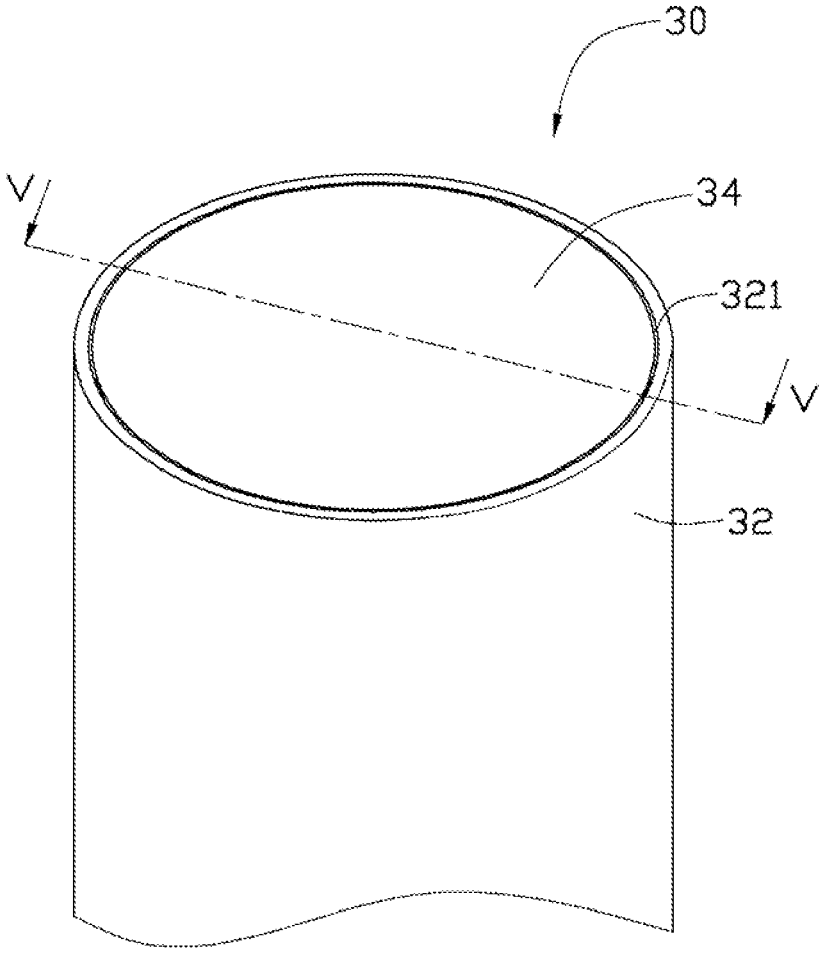
FIG. 2 is a partial, isometric view of the power button of FIG. 1.
Figure 3:
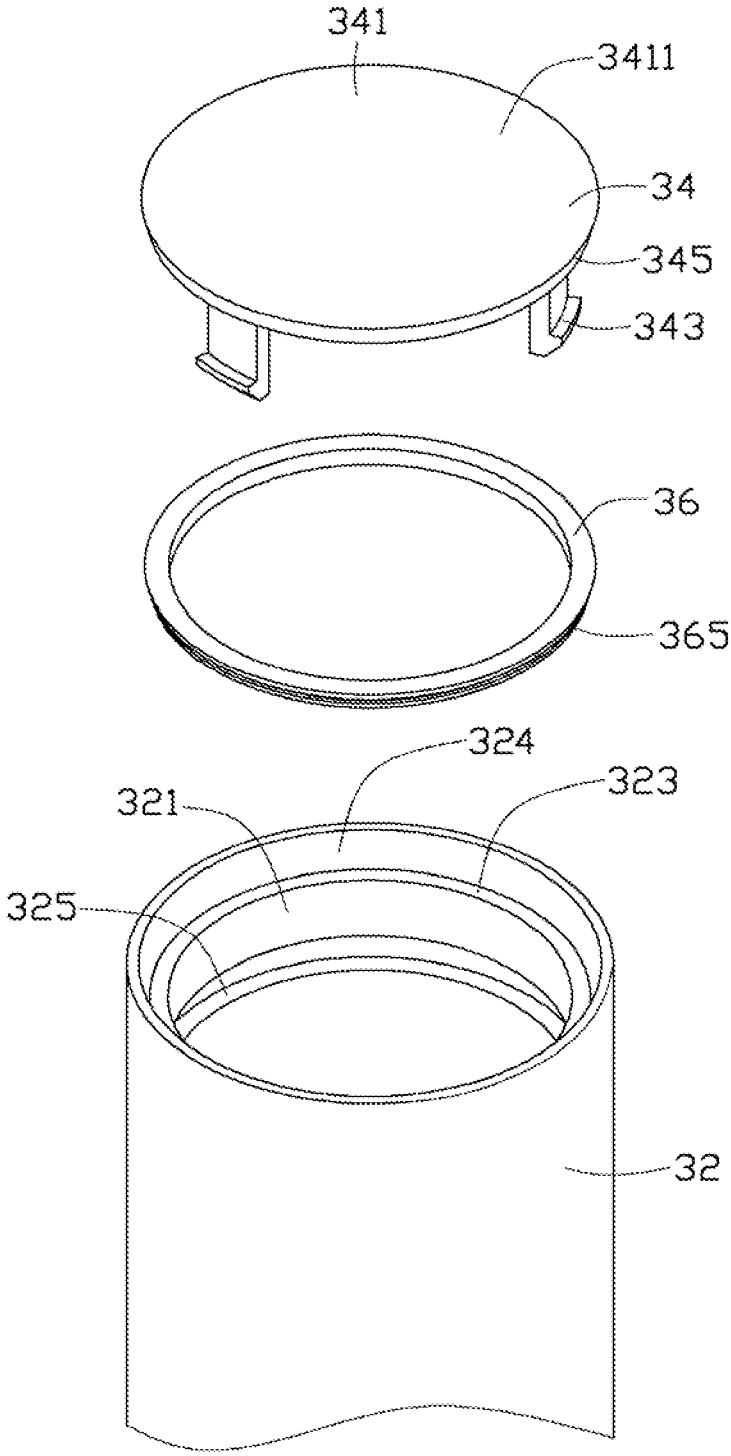
FIG. 3 is an exploded, isometric view of the power button of FIG. 2.
Figure 4:
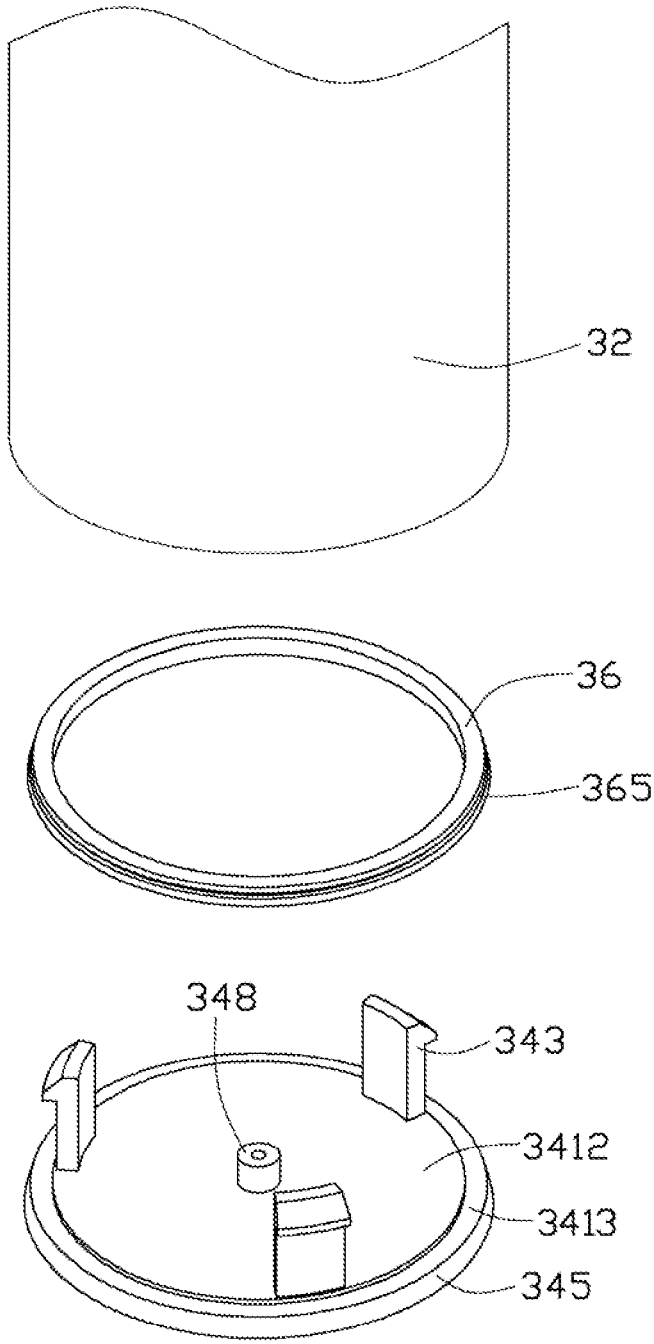
FIG. 4 is similar to FIG. 3, but viewed from another perspective.

Referring to FIGS. 2 through 4, the power button 30 includes a holder 32, a push-button 34 and a sealing member 36. The holder 32 defines an assembling hole 321. The sealing member 36 sleeves on the push-button 34. The push-button 34 along with the sealing member 36 is movably assembled in the assembling hole 321 of the holder 32.

In the illustrated embodiment, the holder 32 is substantially cylindrical. The assembling hole 321 extends along a center axis of the holder 32. The holder 32 defines an annular groove 323 on a top portion of an inner wall of the assembling hole 321 to receive the push-button 34 and the sealing member 36. The annular groove 323 has a conical side surface 324. A diameter of the annular groove 323 increases from the bottom of the annular groove 323 to the top of the annular groove 323.

The holder 32 further includes a latching slot 325 defined in the inner wall of the assembling hole 321 located adjacent to and apart from the annular groove 323. In the illustrated embodiment, the latching slot 325 is annular.

Figure 5:
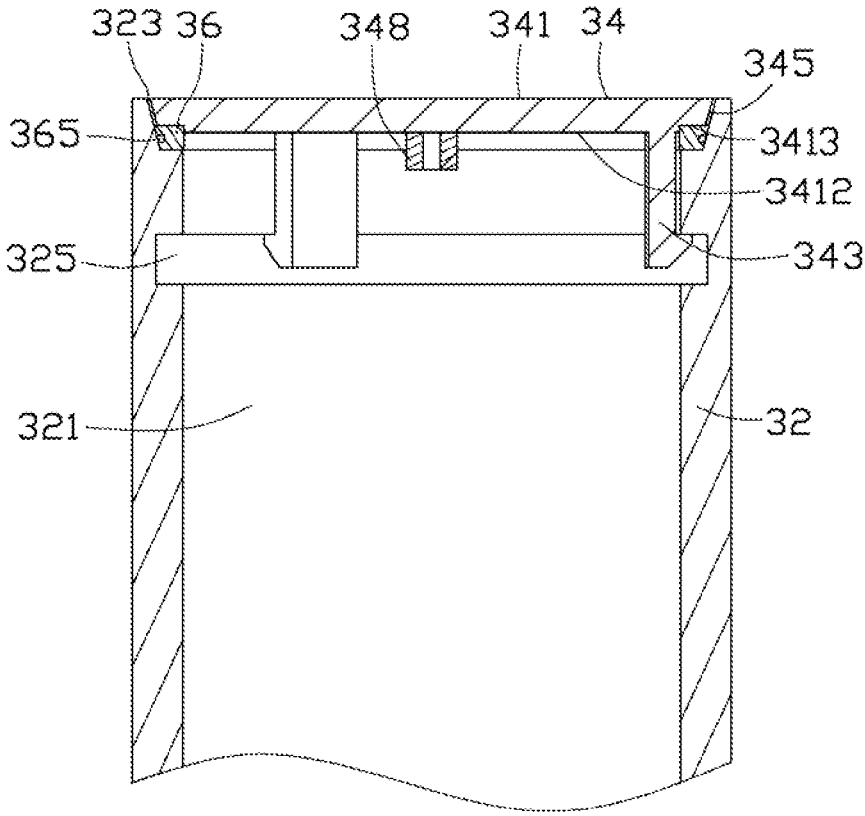
FIG. 5 is a partial, cross-section of the power button of FIG. 2, taken along line V-V.

The push-button 34 includes a cover body 341. The cover body 341 is substantially conical frustum. The cover body 341 includes a top surface 3411, an inner surface 3413 opposite to the top surface 3411, a slanted surface 345 connecting the top surface 3411 and the inner surface 3413, and a protrusion 3412 extending out from the inner surface 3413. A diameter of the top surface 3411 exceeds a diameter of the inner surface 3413. The slanted surface 345 is a conical side surface meshed with a top portion of the conical side surface 324, such that the cover body 341 can be correspondingly received in the annular groove 323. A contact portion 348 is fitted in the center of the protrusion 3412. The contact portion 348 is cylindrical. The contact portion 348 is used to correspondingly press a switch of a printed circuit board (not labeled) of the electronic device 100. A plurality of hook portions 343 are fitted around the contact portion 348 on an edge of the protrusion 3412. In the illustrated embodiment, three hook portions 343 are formed on a circumferential edge portion of the protrusion 3412, are spaced apart from each other, and extend toward the assembling hole 321. Referring to FIG. 5, the hook portions 343 engage with the latching slot 325, thus fixing the push-button 34 to the holder 32. The hook portions 343 may be formed by punching or stamping.

In alternative embodiments, the latching slot 325 can be several grooves arranged apart in an annular manner. The number of the grooves is the same as the number of the hook portions 343.

The sealing member 36 is made from elastic plastic, and is in the shape of a ring corresponding to a bottom portion of the annular groove 323. The sealing member 36 is coiled around the hook portions 343 of the push-button 34, and is adhered to the inner surface 3413 by glue or double-sided adhesive. In use, the sealing member 36 is received in the bottom of the annular groove 323. A circular arc groove 365 is defined in an outer side of the sealing member 36. When the sealing member 36 is pressed, the deformation of the sealing member 36 can be absorbed in the circular arc groove 365.

Referring to FIG. 5, during the assembly of the power button 30, the sealing member 36 sleeves on the push-button 34, and is adhered to the inner surface 3413 of the cover body 341 with glue or double-sided adhesive. The hook portions 343 are applied to engage with the latching slot 325, such that the power-button 34 along with the sealing member 36 is received in the assembling hole 321 of the holder 32, and the sealing member 36 elastically resists the bottom of the annular groove 323.

In operation, the push-button 34 is pressed towards the holder 32, the push-button 34 moves axially towards the holder 32 due to the deformation of the sealing member 36, then the hook portions 343 unlock from the latching slot 325, and the contact portion 348 depresses the switch of the electronic device 100 to turn the power supply on. When the push-button 34 is released, the elastic force is also released because the sealing member 36 accumulates an elastic force and the push-button 34 returns to its original position. The hook portions 343 reengage with the latching slot 325. During the same operation, the contact portion 348 depresses the switch of the electronic device 100 again to turn the power supply off.

It should be noted that the cover body 341 of the push-button 34 is shaped in the form of conical frustum corresponding to the annular groove 323. As a result, the center axis of the contact portion 348 and the holder 32 can coincide with each other continuously. It ensures that the contact portion 348 can depress the switch accurately every time. The sealing member 36 can protect the power button 30 from dust, water, or other contaminations and prolong the lifetime of the power button 30.

It is believed that the present embodiments and their advantages will be understood from the foregoing description, and it will be apparent that various changes may be made thereto without departing from the spirit and scope of the embodiments or sacrificing all of its material advantages.

What is claimed is:

1. A power button, comprising:

a holder comprising an assembling hole defined therein, an annular groove defined on a top portion of an inner wall of the assembling hole and a latching slot defined in the inner wall of the assembling hole located adjacent to and apart from the annular groove;

a push-button comprising a cover body, the cover body being conical frustum shaped and comprising a plurality of hook portions formed on the cover body; wherein the annular groove is meshed with the cover body, the cover body is movably received in the annular groove, and the hook portions are engaged with the latching slot.

2. The power button of claim 1, wherein the latching slot is annular.

3. The power button of claim 1, wherein the latching slot comprises a plurality of grooves arranged apart in an annular manner, and each of the plurality of hook portions engages with a corresponding groove.

4. The power button of claim 1, wherein the power button further comprises a sealing member, the sealing member is coiled around the hook portions of the push-button, and adhered to the cover body by glue or double-sided adhesive, and is wholly received in the bottom of the annular groove.

5. The button of claim 4, wherein the sealing member further comprises a circular arc groove defined in an outer side of the sealing member.

6. The power button of claim 4, wherein the sealing member is made from elastic plastic.

7. The power button of claim 1, wherein the annular groove has a conical side surface, and a diameter of the annular groove increases from the bottom of the annular groove to the top of the annular groove.

8. The power button of claim 7, wherein the cover body comprises a top surface, an inner surface opposite to the top surface, a slanted surface connecting the top surface and the inner surface, and a protrusion extending out from the inner surface.

9. The power button of claim 8, wherein a diameter of the top surface exceeds a diameter of the inner surface, the slanted surface is a conical side surface meshed with a top portion of the conical side surface, such that the cover body is correspondingly received in the annular groove.

10. The power button of claim 8, wherein the body cover comprises a contact portion fitted in the center of the protrusion.

11. The power button of claim 10, wherein the contact portion is cylindrical.

12. The power button of claim 10, wherein the hook portions are fitted around the contact portion on the protrusion.

13. An electronic device comprising:

a housing defining a receiving hole therein;

a holder comprising an assembling hole defined therein, an annular groove defined on a top portion of an inner wall of the assembling hole and a latching slot defined in the inner wall of the assembling hole located adjacent to and apart from the annular groove;

a push-button comprising a cover body, the cover body being conical frustum shaped and comprising a plurality of hook portions formed on the cover body; wherein the annular groove meshes with the cover body, the cover body is movably received in the annular groove, and the hook portions engage with the latching slot.

14. The electronic device of claim 13, wherein the latching slot is annular.

15. The electronic device of claim 13, wherein comprises a plurality of grooves arranged apart in an annular manner, and each of the hook portions engages with a corresponding groove.

16. The electronic device of claim 13, wherein the power button further comprises a sealing member, the sealing member is coiled around the hook portions of the push-button, and adhered to the cover body by glue or double-sided adhesive, and is wholly received in the bottom of the annular groove.

17. The electronic device of claim 16, wherein the sealing member further comprises a circular arc groove defined in an outer side of the sealing member.

18. The electronic device of claim 16, wherein the sealing member is made from elastic plastic.

19. The electronic device of claim 13, wherein the annular groove has a conical side surface, and a diameter of the annular groove increases from the bottom of the annular groove to the top of the annular groove.

20. The electronic device of claim 19, wherein the cover body comprises a top surface, an inner surface opposite to the top surface, a slanted surface connecting the top surface and the inner surface, and a protrusion extending out from the inner surface.

* * * * *